US008080321B2

(12) United States Patent
Sakakibara

(10) Patent No.: US 8,080,321 B2
(45) Date of Patent: Dec. 20, 2011

(54) RUST-PREVENTIVE METALLIC COMPONENT PART

(75) Inventor: Kazutoshi Sakakibara, Aichi-gun (JP)

(73) Assignee: Togo Seisakusyo Corporation, Aichi-ken (JP)

( * ) Notice: Subject to any disclaimer, the term of this patent is extended or adjusted under 35 U.S.C. 154(b) by 188 days.

(21) Appl. No.: 12/226,221

(22) PCT Filed: Apr. 25, 2006

(86) PCT No.: PCT/JP2006/309139

§ 371 (c)(1), (2), (4) Date: Oct. 10, 2008

(87) PCT Pub. No.: WO2007/129393

PCT Pub. Date: Nov. 15, 2007

(65) Prior Publication Data

US 2009/0155618 A1 Jun. 18, 2009

(51) Int. Cl.

| | |
|---|---|
| ***B32B 15/04*** | (2006.01) |
| ***B32B 15/08*** | (2006.01) |
| ***B32B 15/18*** | (2006.01) |
| ***B32B 15/20*** | (2006.01) |
| ***F16F 1/00*** | (2006.01) |
| ***F16F 1/02*** | (2006.01) |
| ***F16F 1/20*** | (2006.01) |

(52) U.S. Cl. ..... 428/632; 428/340; 428/626; 428/659; 428/681; 428/332; 428/652; 428/446; 428/448; 428/450; 267/166; 267/158

(58) Field of Classification Search ..... 428/628, 428/201, 621, 364, 369, 370, 371, 375, 379, 428/380, 381, 383, 389, 332, 334, 335, 336, 428/340, 341, 219, 624, 626, 658, 659, 681, 428/684, 685, 630, 631, 632, 633, 650, 652, 428/653, 446, 448, 450

See application file for complete search history.

(56) References Cited

U.S. PATENT DOCUMENTS 4,246,317 A * 1/1981 Helwig ..... 428/375

(Continued)

FOREIGN PATENT DOCUMENTS

JP 06229409 8/1994

(Continued)

OTHER PUBLICATIONS

Machine Translation, Sakakibara, JP 2006-83464, Mar. 2006.*

(Continued)

*Primary Examiner* — Michael Lavilla

(74) *Attorney, Agent, or Firm* — Jacobson Holman PLLC

(57) ABSTRACT

The present invention relates to a rust-preventive metallic component part in which a steel wire to which wire-drawing processing is performed is adapted into a substrate and which comprises a rust-preventive coating film being free from chromium on a surface of the substrate, and to a manufacturing method for the same; and its object is to provide a rust-preventive metallic component part whose rust-preventive coating film exhibits such good adhesiveness to substrate that it is not come off by elastic deformations in service, by sliding contacts at the time of transportation, and the like, and to provide a manufacturing method for the same.

A rust-preventive metallic component part according to the present invention is characterized in that: it comprises a first coating film, which is formed on a surface of a substrate and which comprises an inorganic-compound-containing coating film being free from chromium; and a residual proportion of zinc phosphate coating film or manganese phosphate coating film, which has been formed on the surface of the substrate at the time of wire-drawing processing, is less than 25% of a surface area of the substrate. Consequently, the first coating film is coated after removing the zinc phosphate coating film or manganese phosphate coating film, which covers the surface of the substrate, with a strongly-alkaline degreasing liquid.

5 Claims, 1 Drawing Sheet

U.S. PATENT DOCUMENTS

| | | | | |
|---|---|---|---|---|
| 6,599,643 | B2 * | 7/2003 | Heimann et al. | 428/623 |
| 2002/0119337 | A1 * | 8/2002 | Maze et al. | 428/553 |
| 2005/0119133 | A1 * | 6/2005 | Komiyama et al. | 508/100 |

FOREIGN PATENT DOCUMENTS

| | | | |
|---|---|---|---|
| JP | 11-280807 | | 10/1999 |
| JP | 2000-065110 | * | 3/2000 |
| JP | 2002-212508 | | 7/2002 |
| JP | 2002285102 | | 10/2002 |
| JP | 2004-232058 | | 8/2004 |
| JP | 2006-83464 | | 3/2006 |
| WO | WO 03/080774 | * | 10/2003 |

OTHER PUBLICATIONS

Machine Translation, Fujiwara et al., JP 2004-232058, Aug. 2004.*
Machine Translation, Matsumoto et al., JP 2000-065110, Mar. 2000.*
Machine Translation, Kiyota et al., JP 11-280807, Oct. 1999.*
Machine Translation, Makimae et al., JP 06-229409, Aug. 1994.*
Fukushima, "On Non-chromium Paint Processing System", Rust Prevention & Control Japan, Japan Association of Corrosion Control, Mar. 2004, pp. 18-22.
Notification of reasons for refusal, mailed Aug. 2, 2011, Japanese Pat. App. No. 2008-514337.

* cited by examiner

RUST-PREVENTIVE METALLIC COMPONENT PART

This is a national stage of PCT/JP2006/309139 filed Apr. 25, 2006 and published in Japanese.

TECHNICAL FIELD

The present invention relates to a rust-preventive metallic component part in which a rust-preventive treatment is performed to a substrate surface of iron and steel materials, and a manufacturing method for the same.

BACKGROUND ART

Recently, environmental problems have become the foremost issue, and the use control to the surface treatments for automobile component parts, that is, to harmful substances, among them, to heavy metals (lead, cadmium, mercury and hexavalent chromium), has been strengthened, and their use has come to be restricted starting mainly in Europe.

Accordingly, rust-preventive coating films by means of Non-chromium Paint Processing System that does not include chromium have been developed ("On Non-chromium Paint Processing System" by FUKUSHIMA, pp. 18-22, March, 2004, RUST PREVENTION & CONTROL JAPAN, Japan Association of Corrosion Control). However, in these rust-preventive coating films that do not include chromium, the adhesiveness to substrate is low compared with that in conventional metallic powder-chromate chemical coating films that include chromium. In particular, in small-sized metallic component parts, such as wire springs in which steel wires, like piano wires and hard drawn steel wires being subjected to cold working, are adapted into the raw materials, the coated rust-preventive coating films cannot follow the elastic deformation of metallic component parts so that the micro-cracks or coming-off might occur. Moreover, such problems have arisen that, because of the vibrations when being transported or conveyed, component parts collide with each other and/or contact with each other slidingly and thereby the rust-preventive coating films come off partially to impair the appearance and additionally to degrade the corrosion resistance. Consequently, a rust-preventive metallic component part, which comprises a rust-preventive coating film whose adhesiveness to substrate is much stronger and firmer, and a manufacturing method for the same have been longed for.

DISCLOSURE OF THE INVENTION

The present invention aims at providing a rust-preventive metallic component part, which is a metallic component part comprising a rust-preventive coating film that does not include chromium, and whose adhesiveness to substrate is so good that the rust-preventive coating film is not come off by elastic deformations in service, by sliding contacts at the time of transportation, and the like; and at providing a manufacturing method for the same.

A rust-preventive metallic component part according to the present invention is a rust-preventive metallic component part in which a steel wire to which wire-drawing processing is performed is adapted into a substrate and which comprises a rust-preventive coating film on a surface of the substrate, and is characterized in that:

it comprises a first coating film, which is formed on the surface of the substrate and which comprises an inorganic-compound-containing coating film being free from chromium; and a residual proportion of zinc phosphate coating film or manganese phosphate coating film, which has been formed on the surface of the substrate at the time of said wire-drawing processing, is less than 25% of a surface area of the substrate.

In the rust-preventive metallic component part according to the present invention, since the zinc phosphate coating film or manganese phosphate coating film, which changes in quality at high temperature when being hot cured, accounts for less than 25% of a surface area of the substrate on the surface of the substrate, the adhesiveness of the rust-preventive coating film to the substrate is high. Consequently, because of elastic deformations in service, and even when the metallic component parts collide with each other and/or contact slidingly with each other because of vibrations at the time of transportation or conveyance, the rust-preventive coating film does not come off at all.

In the rust-preventive metallic component part according to the present invention, it is desirable that an inorganic-compound-containing coating film, the first coating film, can be a zinc-containing coating film. The zinc-containing coating film as a rust-preventive coating film demonstrates a good rust-preventive effect because of the substrate-surface shielding effect by means of coating a film and because of the controlled galvanic protection action of zinc with respect to steel materials.

It is allowable that a coating amount of such a first coating film can be adapted into being 150-500 mg/dm$^2$. By adapting the coating amount into being this range, it is possible to turn it into a rust-preventive coating film that is good in strength and corrosion resistance.

Moreover, in the rust-preventive metallic component part according to the present invention, it is possible to further comprise a second coating film, which includes an organic resin and/or water glass, on a surface of said first coating film. By comprising such a second coating film, it is possible to arrange the appearance of the first coating film that is a rust-preventive coating film, to prevent electric corrosion, and to suppress the occurrence of white rust. Further, since it contains an organic resin, it is possible to suppress the cracking of rust-preventive coating films that occurs when metallic component parts deform, and it is possible to turn it into a good rust-preventive metallic component part in which no red rust arises over a long period of time.

In the rust-preventive metallic component part according to the present invention, it is possible to further coat a rust-preventive oil on a surface of the first coating film. Since a film of oil composition with water-repellent action is formed on a surface of the first coating film, it is possible to shut off corrosive environments, such as oxygen and moisture in air, with respect to the substrate of metallic component part.

As for a rust-preventive metallic component as described above, it is possible to exemplify an elastic member for wire-forming metallic component parts, and the like, such as wire springs or wire clips.

A manufacturing method according to the present invention for rust-preventive metallic component part is a manufacturing method for rust-preventive metallic component part in which a steel wire to which wire-drawing processing is performed is adapted into a substrate and which comprises a rust-preventive coating film on a surface of the substrate, and is characterized in that it includes:

a molding step of molding the substrate as a predetermined configuration;

a degreasing step of degreasing a surface of the substrate, which has been molded; and a first-coating-film forming step of forming a first coating film, which comprises an inorganic-compound-containing coating film being free from chromium, on the surface of the substrate, which has been degreased.

In the manufacturing method according to the present invention for rust-preventive metallic component part, the degreasing step can be a step of removing zinc phosphate coating film or manganese phosphate coating film, which is coated on the surface of the substrate, along with adhered fats by means of a strongly-alkaline degreasing liquid. On the surface of the substrate that has been molded, a zinc phosphate treatment or a manganese phosphate treatment is performed in order to make cold working, such as wire drawing, coiling and wire forming, easier, and fats, such as lubricating oils, are adhered. Since zinc phosphate and manganese phosphate comprise crystal water, they turn into anhydrous salts when baking rust-preventive coating films at a high temperature of 230° C. or more, the films change in quality to degrade the adhesiveness to substrate. Accordingly, in the present invention, they are removed virtually along with the fats using a strongly-alkaline degreasing liquid.

The degreasing liquid can be an aqueous solution, which contains sodium hydroxide in an amount of 0.1-20% by mass and whose pH is 10-13; and it is allowable that substrate, which has been molded, can be immersed in the degreasing liquid, which is held at 60-90° C., thereby doing a degreasing treatment for 5-15 minutes. By applying such a solution and degreasing conditions thereto, it is possible to remove zinc phosphate and manganese phosphate coating films, which are coated on a surface of steel wire, effectively.

In the manufacturing method according to the present invention for rust-preventive metallic component part, it is preferable that a baking temperature of the first coating film can be 250-400° C. By means of baking the first coating film in this temperature range, it is possible to form a much stronger and firmer rust-preventive coating film.

Moreover, in the manufacturing method according to the present invention for rust-preventive metallic component part, it is allowable to further comprise a second-coating-film forming step of forming a second coating film, which includes an organic resin and/or water glass, on a surface of said inorganic-compound-containing coating film, which has been formed.

The manufacturing method according to the present invention for rust-preventive metallic component part as mentioned above can be executed without ever changing conventional manufacturing lines for forming rust-preventive coating films on metallic components greatly.

BEST MODE FOR CARRYING OUT THE INVENTION

Figure 1:
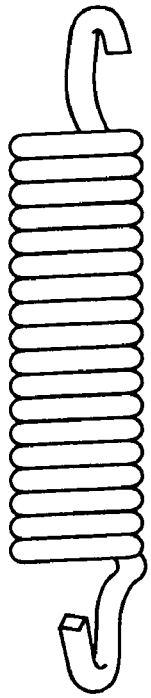
FIG. 1 is an outline diagram for illustrating a tension spring according to a present embodiment.

A rust-preventive metallic component part according to the present invention is a rust-preventive metallic component part in which a steel wire to which wire-drawing processing is performed is adapted into a substrate and which comprises a rust-preventive coating film on a surface of the substrate, and is characterized in that: it comprises a first coating film, which is formed on the surface of the substrate and which comprises an inorganic-compound-containing coating film being free from chromium; and a residual proportion of zinc phosphate coating film or manganese phosphate coating film (hereinafter referred to as "lubricating coating film"), which has been formed on the surface of the substrate at the time of said wire-drawing processing, is less than 25% of a surface area of the substrate.

Specifically, in a rust-preventive metallic component part according to a present embodiment, a piano wire or a hard drawn steel wire, which is formed so as to obtain desirable strength by performing wire-drawing processing thereto, is adapted into a raw material. In these steel wires, zinc phosphate treatments or manganese phosphate treatments have been performed onto their surfaces in order to enhance the lubricating property at the time of wire-drawing processing. Since the first coating film, which comprises an inorganic-compound-containing coating film that is free from chromium, demonstrates a good rust-preventive effect by undergoing bake coating at a higher temperature than having been done conventionally, zinc phosphate and manganese phosphate release the crystal water while being baked at this higher temperature, thereby changing the first coating film in quality. Accordingly, the adhesiveness between the first coating film and the substrate degrades. Hence, in the present embodiment, the first coating film is formed on a surface of the substrate on which a residual proportion of the lubricating film is less than 25% of a surface area of the substrate.

Hereinafter, the rust-preventive metallic component part according to the present embodiment will be explained in detail along with the manufacturing method.

A manufacturing method for the rust-preventive metallic component part according the present embodiment includes: a molding step of molding a substrate, which comprises a steel wire, as a predetermined configuration; a degreasing step of degreasing a surface of the substrate, which has been molded; and a first-coating-film forming step of forming a first coating film, which comprises an inorganic-compound-containing coating film being free from chromium, on the surface of the substrate, which has been degreased. It is possible to further comprise a second-coating-film forming step of forming a second coating film, which includes an organic resin and/or water glass, on a surface of the first coating film, which has been formed, or a rust-preventive-oil coating step of coating a rust-preventive oil thereon.

(Molding Step)

In the substrate of the rust-preventive metallic component part, a steel wire, such as hard drawn steel wires and piano wires, to which cold working by means of wire drawing has been performed, is adapted into a raw material, and it is possible to mold it by an ordinary method, such as coiling and wire-forming working. Note that, in the wire-drawing working and coiling of the raw material, or in the wire forming and the like thereof, it is even allowable to perform a surface treatment, such as a zinc phosphate treatment or a manganese phosphate treatment, thereto.

(Degreasing Step)

At the degreasing step, the lubricating coating film on the surface of the substrate is removed along with adhered fats.

In the lubricating coating film, since the adhesiveness to the substrate is high, a degreasing treatment is carried out by immersing it into a strongly-alkaline solution whose pH is 10-13. When the pH of the degreasing solution is less than 10, it is not possible to remove the lubricating coating film on the surface of the substrate; whereas, when the pH exceeds 13, since a measure against the corrosion of degreasing bath might be needed, it is not preferable. A more preferable value of the pH can be 11-13.

This strongly-alkaline solution can be an aqueous solution, which contains sodium hydroxide in an amount of 0.1-20% by mass, an accelerator agent whose major component is sodium metasilicate that accelerates the washability, and the like. When the sodium hydroxide being a major component is less than 0.1% by mass, it is not possible to remove the zinc phosphate coating film or manganese phosphate coating film sufficiently. When it is contained in a large amount in excess of 20% by mass, since the inconvenience, such as the dissolving of iron texture and the precipitation, might occur, it is not preferable. A more preferable content of sodium hydroxide can be 1-18% by mass.

As set forth above, the accelerating agent can be added by 5-15 points for the purpose of improving the washability by decomposing dirt. When the addition amount of the accelerating agent is less than 5 points, dirt has agglomerated; when it is added in a large amount in excess of 15 points, since the accelerating agent might precipitate, it is not appropriate. Being more preferable can be 5-10 points.

Further, it is allowable to control a free alkalinity of this aqueous solution in a range of 5-30 points. The free alkalinity is an index for specifying alkaline ions being degreasing components (being hydroxide ions and metasilicate ions herein) quantitatively; when the free alkalinity is less than 5 points, since the degreasing is insufficient, it is not appropriate. On the other hand, when it exceeds 30 points, since it might corrode iron texture, it is not preferable. Being more preferable can be 10-27 points, and being much more preferable can be 20-24 points.

Into the alkaline aqueous solution being prepared as above, the substrate having been molded as a predetermined configuration is immersed, thereby performing a degreasing treatment thereto at 60-90° C. for 5-15 minutes. After completing the degreasing, it is washed with water, thereby removing the adhered alkaline aqueous solution therefrom. By performing the alkaline degreasing as above, it is possible to make a film residual proportion of the lubricating coating film on the surface of the substrate less than 25% of a surface area the substrate.

Table 1 is an example that designates a relationship between degreasing conditions and residual proportions of zinc phosphate coating films being formed on the surface of a substrate. Here, the film residual proportions are percentages that phosphate-coating-film areas occupy in a visual-field area when observing the surfaces of after-degreasing-treatment substrates with a microscope (being fifty fold). In Sample No. 0, since no degreasing treatment was carried out, the film residual proportion was 100%. Since Sample No. 1 was a standard sample, the film residual proportion was 25%. That is, it has been confirmed that, when the film residual proportion is 25% or less, favorable adhesiveness is obtainable for the first coating film. Therefore, in Sample Nos. 2-10 being designated in Table 1, it is assumed that the adhesiveness of the first coating films was favorable.

TABLE 1

| Sample No. | Degreasing Temperature (° C.) | Degreasing Time (minute) | Film Residual Proportion (%) | Remarks |
|---|---|---|---|---|
| 0 | — | — | 100 | — |
| 1 | 60 | 5 | 25 | New Liquid |
| 2 | 70 | 5 | 20 | Solution being |

TABLE 1-continued

| Sample No. | Degreasing Temperature (° C.) | Degreasing Time (minute) | Film Residual Proportion (%) | Remarks |
|---|---|---|---|---|
| 3 | | 8 | 17 | Blended while |
| 4 | | 10 | 16 | Assuming |
| 5 | 80 | 5 | 19 | Deterioration |
| 6 | | 8 | 15 | resulting from |
| 7 | | 10 | 10 | Degreasing |
| 8 | 90 | 5 | 19 | |
| 9 | | 8 | 12 | |
| 10 | | 10 | 4 | |

(First-Coating-Film Forming Step)

Next, a first coating film is formed on the surface of the substrate from which the lubricating coating film has been removed virtually by doing degreasing as aforementioned. The first coating film is a rust-preventive coating film; as for the processing liquid, a processing liquid, which does not include any chromium but includes an inorganic compound, is used. As the processing liquid, it is possible to use one that has been known heretofore as disclosed in U.S. Pat. No. 5,868,819; as for the inorganic compound, it is possible to suitably employ a silicate compound, which includes a metallic zinc powder and/or metallic zinc flakes or aluminum flakes. In the same manner as the conventional zinc powder-chromate composite coating film, a film structure that results from this silicate compound takes on a structure in which metallic flakes are overlapped in a layered manner and are combined by an inorganic binder, and can inhibit metallic component parts from rusting by means of the controlled galvanic protection action of zinc and the shutoff effect, which results from the metallic flakes, to the ambient air.

Such a first coating film can be formed by the same method as the prior art. As for a coating method, it is efficient to adopt a tank basket system (dipping-and-spinning system) in which molded substrates are put in a basket and are then immersed into a processing liquid that has been prepared by predetermined procedures within an ordinary tank, and in which they were pulled up and then the excessive processing liquid is removed by means of centrifugal spinning-off. However, it is allowable to adopt a hanger system (dipping-and-draining system) in which they are hung from an overhead conveyor and are then immersed into a bath (processing liquid) to coat them; in addition to these, it can be executed by spray coating, and the like, without being ever limited to the coating method.

After this coating treatment, a baking treatment is carried out under predetermined conditions. It is allowable that a baking temperature of the first coating film can fall in a range of 250-450° C. When the baking temperature is less than 250° C., no sufficient controlled galvanic protection action resulting from zinc powder and so on is obtained, and moreover no sufficient film hardness and adhesiveness are obtainable. On the other hand, when it exceeds 400° C., since the zinc powder might change in quality, it is not preferable. Being more preferable can be 300-370° C.

Here, it is preferable that a coating amount of the first coating film can be 150-500 mg/dm$^2$. When the coating amount is less than 150 mg/dm$^2$, no sufficient corrosion resistance is obtained; moreover, when it exceeds 500 mg/dm$^2$, since the adhesiveness to the substrate degrades so that it becomes likely to come off, it is not appropriate. Being more preferable can be 200-400 mg/dm$^2$.

Since the first coating film containing zinc possesses the controlled galvanic protection action of zinc, and the shutoff action (barrier effect) of shutting off a surface of the substrate from the atmosphere by means of laminated metallic flakes, it can inhibit metallic component parts, which are made by molding steel materials, from rusting effectively.

(Second-Coating-Film Forming Step)

Since the first coating film containing zinc possesses the controlled galvanic protection action of zinc, and the shutoff action to the atmosphere, shutoff action which results from the secondary products of zinc, it is possible to effectively inhibit metallic component parts, which are made by molding steel materials, from rusting. However, for the appearance of the first coating film, for preventing the occurrence of white rust resulting from the oxidation of zinc, and the like, it is desirable to further form the second coating film for protecting the first coating film.

The second coating film is a film, which contains an organic resin and/or water glass. Since it includes an organic resin, it can follow the elastic deformations of the substrate, and moreover, since it includes water glass, it keeps the iron texture being alkaline and thereby makes it possible to suppress the superficial corrosion. Moreover, although the appearance of the first coating film is a dull surface, it is possible to obtain a glossy superficial appearance by forming the second coating film.

As an organic resin, it is possible to employ a proper resin, such as fluorocarbon resin, acrylic resin, epoxy resin, phenol resin, polyester resin and silicone resin. Moreover, as water glass, although sodium silicate, calcium silicate, and the like, are employable, it is needed to exhibit compatibility to resin. As for a blending amount of water glass, it is allowable to blend it as $SiO_2$ in a range of 1-200 with respect to 100 of resinous solid content. When the blending amount of $SiO_2$ is or less, the corrosion-resistance improvement effect is not sufficient; on the other hand, when it becomes 200 or more, it is not preferable because the adhesion performance degrades, and soon. Being much preferable can be 3-100.

In addition to above, it is allowable to even add a lubricating agent, such as wax, and an additive agent, such as a dispersing agent, a moistening agent and a thickening agent, if necessary; and it is allowable to even employ pigments, such as body pigments and rust-preventive pigments.

There are not any limitations to a forming method of the second coating film, it is allowable to carry it out by an ordinary method, and it is possible to properly adopt a dipping-and-spinning system in which dipping and then spinning off a surplus content are carried out, a hanger system, a curtain system, and a spray system, and the like. Moreover, as baking conditions for the second coating film, it is possible to use ordinary conditions, too. For example, it is allowable to select them in ranges of 60-250° C. and 5-60 minutes approximately. The adhesion amount of the second film, which is obtainable by repeating such processes once or more, can be 5-50 mg/dm$^2$. When it is 5 mg/dm$^2$ or less, the protective action for the first coating film is not sufficient; moreover, when it exceeds 50 mg/dm$^2$, it is not preferable because the adhesiveness degrades so that it might become likely to come off. Being more preferable can be 10-40 mg/dm$^2$.

(Rust-Preventive Oil Coating Step)

Since the first coating film does not contain chromium, it does not possess any self-repairing ability as conventional chromium-containing coating films do. Therefore, in a wire spring, for instance, in the case of the separated sections of the contractually-wound portion that is pulled off to separate in service, and when come-off or cracking is caused to the surface by vibrations in transportation, and the like, so that a surface of the substrate (a texture surface) has been exposed, it is not possible to suppress the occurrence of corrosion to the exposed surface without any new operation. Accordingly, it is allowable to further coat a rust-preventive oil onto a surface of the first coating film.

There are not any limitations to a rust-preventive oil, and it is possible to use a widely-known rust-preventive oil composition in which a corrosion inhibitor agent, an alkaline additive agent, wax, or a thickening agent, or the like, is blended with a base oil.

Moreover, it is allowable to coat a rust-preventive oil by an ordinary method, and it is possible to properly adopt a dipping-and-spinning system in which dipping and then spinning off a surplus content are carried out, a hanger system, a curtain system, and a spray system, and the like. Note that a coated rust-preventive oil composition can be dried at an ordinary temperature, or with a warm air of 70° C. or less, for about 1-5 minutes. By doing the drying, it is possible to form a rust-preventive oil coating film with 2-30 μm on a surface of the first coating film.

Hereinafter, a rust-preventive metallic component part according to the present invention and a manufacturing method for the same will be explained in more detail by means of testing examples.

Testing Example No. 1

Making of Samples

First of all, as a substrate, a substrate for tension spring as shown in FIG. 1 and with coil outside diameter: 15 mm, free length: 58 mm, and total number of turns: 17.5 turns was obtained in a quantity of 200 pieces by molding a steel wire with a diameter of 2 mm (piano wire SWP-B).

Onto the surface of the obtained substrate for tensile spring (200 pieces), a degreasing treatment was performed by means of a strongly-alkaline aqueous solution. As for the strongly-alkaline aqueous solution, the 5% aqueous solution of "FINE CLEANER 4461 (pH 13)," which was produced by NIHON PARKERIZING Co., Ltd., was employed, and the degreasing conditions were adapted into being 65° C.×10 minutes. After water washing the respective after-degreasing-treatment samples by immersing them into tap water with ordinary temperature for about 1 minute, a first coating film was formed on them in the following manner. Note that the residual proportion of lubricating film was 9% after the degreasing.

The tension-spring substrate (200 pieces) to which the alkaline degreasing had been carried out was immersed into a first-coating-film forming solution ("GEOMET R720" produced by NIPPON DACRO SHAMROCK Co., LTD.) at 20-25° C. for 2-6 minutes; and then, after the immersion, the forming solution in surplus was spun off centrifugally at 220 rpm to adhere a predetermined amount of a processing liquid thereon. Further, it was heated at 320-360° C. for 30-45 minutes in an electric-heating type hot-air circulator oven, and was thereafter left to cool at room temperature. These processes were repeated twice, thereby forming a first coating film whose coating amount was 350 mg/dm$^2$.

200 samples with the first coating film formed were divided into Sample Group "A" and Sample Group "B," each of which comprised 100 pieces of them respectively, and then a second coating film was further formed on a surface of the first coating films. That is, the respective sample groups were immersed into "PLUS 10" (conversion into $SiO_2$ solid content: 10% by mass), which was produced by NIPPON DACRO SHAMROCK Co., LTD. and in which sodium silicate was the major component, at 25° C.×5 minutes; after the immersion, it was spun off centrifugally to adhere a predetermined amount of a processing liquid thereon; and then it was heated at 180° C. for 20 minutes in an electric-heating type hot-air circulator oven; and then it was left to cool at room temperature. To Sample Group "A" (100 pieces), this second-coating-film processing was performed once, thereby forming a second coating film whose coating amount was 20 mg/dm$^2$. Moreover, to Sample Group "B" (100 pieces), this second-coating-film processing was performed twice, thereby forming a second coating film whose coating amount was 40 mg/dm$^2$.

(Testing Method and Judging Method)

Each sample group (100 pieces) was accommodated in a metallic container with 300-mm length×300-mm width×100-mm depth, and was reciprocated horizontally 100 times at a speed: 50 mm/sec. and with an amplitude (on one side): 50 mm, thereby colliding the samples with each other.

Figure 2:
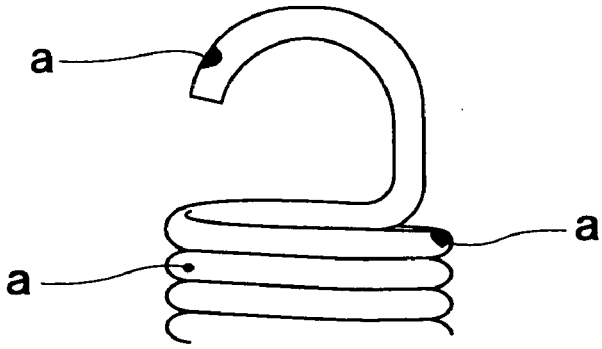
FIG. 2 is an enlarged diagram of the tension spring adjacent to a hook portion, and many locations (black-tainted spots "a"), from which a rust-preventive coating film had come off to expose a surface of the substrate, are appreciable.
Figure 3:
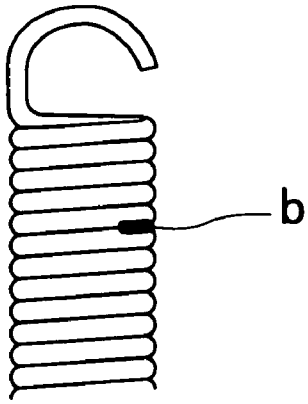
FIG. 3 is a diagram for explaining a reservoir fault, and a residual "b," which was made in the vicinity between wires by an excessive film-processing liquid that cured to adhere on a film surface, is appreciable.

After completing the aforementioned come-off test, the individual samples were inspected visually while rolling them on a surface plate, thereby confirming the come-off of the rust-preventive coating films and the existence or nonexistence of reservoir (the surplus film processing liquid that was fastened to the surfaces of the films and is designated with "b" in FIG. 3). At the come-off locations where the texture surfaces were exposed (the black-tainted spots "a" in FIG. 2), those in which the come-off with 1-mm square or greater was appreciated at one location or more were regarded as "come-off fault"; those in which the reservoir with 5-mm length or longer was appreciated in a quantity of one or more were regarded as "reservoir fault"; and they were judged to be failure. Those in which no such defects were recognized were judged to be satisfactory.

(Test Results)

The judgment results are given in Table 2 along with the film constructions. In Sample Group "A" in which the adhesion amount of the second film was 20 mg/dm$^2$, it was extremely favorable because 96 of them were satisfactory and because 2 of them were "come-off fault." Moreover, in Sample Group "B," 79 of them were satisfactory and 6 of them were "come-off fault."

The respective sample groups were evaluated in the same manner as Testing Example No. 1, and the evaluation results that are given altogether in Table 2 were obtained.

It is understood that the adhesiveness of the first coating films was inferior to that in Testing Example No. 1, because 33 of them were "come-off fault" in Sample Group "C," and because 20 of them were so in Sample Group "D." This is because the lubricating coating films at the time of wire drawing that adhered to the surfaces of the substrates could not be removed by the methylene chloride degreasing.

Testing Example No. 3

Except that no degreasing treatment was performed to the after-molding tension-spring substrates, Sample Group "E" (the coating amount of the second coating film being 20 mg/dm$^2$: 100 pieces) and Sample Group "F" (the coating amount of the second coating film being 40 mg/dm$^2$: 100 pieces) were obtained in the same manner as Testing Example No. 1.

The respective test-specimen groups were evaluated in the same manner as Testing Example No. 1, and the evaluation results that are given altogether in Table 2 were obtained.

In Sample Group "E," 27 of them were "come-off fault," whereas, in Sample Group "F," 27 of them were so, and it is understood that the adhesiveness of the first coating films was poor due to the lubricating coating films at the time of wire drawing that adhered to the surfaces of substrates.

As described above, it is possible to improve the adhesiveness of the first coating film being a rust-preventive coating film remarkably by virtually removing the lubricating coating films at the time of wire drawing, lubricating coating films which adhere to the surfaces of the substrates, by means of degreasing with a strongly-alkaline solution.

INDUSTRIAL APPLICABILITY

The rust-preventive metallic component part according to the present invention, and the manufacturing for the same are useful when they are applied to wire-forming metallic component parts, such as elastic members, like wire springs and so on, and wire clips, in which a steel wire, like a piano wire or a hard drawn steel wire, to which cold working is performed, is adapted into the raw material.

TABLE 2

| | | Degreasing Treatment & Rust-preventive Coating Film | | | Come-off Test Results (Quantity) | | |
|---|---|---|---|---|---|---|---|
| | | | | | | Quantity of Failure Pieces | |
| Test No. | Sample Group | Degreasing Treatment | First Coating Film | Second Coating Film mg/dm$^2$ | Quantity of Satisfactory Pieces | Quantity of "Come-off Fault" Pieces | Quantity of "Reservoir Fault" Pieces |
| 1 | A | Alkaline | (2C2B) | 20 | 96 | 2 | 2 |
| | B | Degreasing | 350 mg/dm$^2$ | 40 | 79 | 6 | 15 |
| | | F-4461 | | | | | |
| 2 | C | Methylene | | 20 | 59 | 33 | 8 |
| | D | Chloride | | 40 | 67 | 20 | 13 |
| 3 | E | None | | 20 | 55 | 27 | 18 |
| | F | | | 40 | 63 | 27 | 10 |

Testing Example No. 2

Except that the degreasing treatment was adapted into methylene chloride degreasing, Sample Group "C" (the coating amount of the second coating film being 20 mg/dm$^2$: 100 pieces) and Sample Group "D" (the coating amount of the second film being 40 mg/dm$^2$: 100 pieces) were obtained in the same manner as Testing Example No. 1. The methylene chloride degreasing is a publicly-known degreasing method in which a substrate for tension spring is immersed into a methylene chloride solution for 20 minutes.

The invention claimed is:

1. A rust-preventive metal part comprising:

a substrate, which is a steel wire to which wire-drawing processing is performed; and a rust-preventive coating film on a surface of the substrate;

wherein the rust-preventative film comprises a first coating film, which is formed on the surface of said substrate and which comprises an inorganic-compound-containing coating film being free from chromium, a coating amount of said first coating film being 150-500 mg/dm$^2$;

wherein the substrate is subject to a degreasing treatment prior to being coated with the rust-preventative film, said degreasing treatment including immersing the substrate in an alkaline solution with pH 10-13, so that a residual amount of zinc phosphate coating film or manganese phosphate coating film, which has been formed on the surface of said substrate at the time of said wire-drawing processing, is less than 25% of the surface of said substrate;

wherein said first coating film comprises a silicate compound including a metallic zinc powder, metallic zinc flakes or aluminum flakes;

wherein said metal part is a wire spring or a wire clip; and wherein the alkaline solution comprises sodium hydroxide in an amount of 0.1 to 20 wt. % and an accelerator whose main component is sodium meta-silicate;

wherein said substrate is washed with water, thereby removing said alkaline aqueous solution, which is adhered after said degreasing treatment.

2. The rust-preventive metal part set forth in claim 1 further comprising a second coating film, which includes an organic resin and/or water glass, on a surface of said first coating film.

3. The rust-preventive metal part set forth in claim 1, wherein a rust-preventive oil is coated on a surface of said first coating film.

4. The rust-preventive metal part according to claim 2, wherein a coating amount of said second coating film is 5-50 mg/dm$^2$.

5. The rust-preventive metal part according to claim 1, wherein a baking treatment is carried out to said first coating film at a temperature of 300-370° C.

* * * * *